US009550648B2

(12) United States Patent
Ohno et al.

(10) Patent No.: US 9,550,648 B2
(45) Date of Patent: Jan. 24, 2017

(54) BOOKLET MAKING METHOD AND APPARATUS

(71) Applicants: Tetsu Ohno, Narashino (JP); Hiroshi Mutou, Daisen (JP); Tsutomu Aburaya, Daisen (JP); Toshihiro Saga, Daisen (JP)

(72) Inventors: Tetsu Ohno, Narashino (JP); Hiroshi Mutou, Daisen (JP); Tsutomu Aburaya, Daisen (JP); Toshihiro Saga, Daisen (JP)

(73) Assignee: MIYAKOSHI PRINTING MACHINERY CO., LTD., Narashino-shi, Chiba (JP)

( * ) Notice: Subject to any disclaimer, the term of this patent is extended or adjusted under 35 U.S.C. 154(b) by 217 days.

(21) Appl. No.: 14/337,950

(22) Filed: Jul. 22, 2014

(65) Prior Publication Data

US 2015/0043997 A1 Feb. 12, 2015

(30) Foreign Application Priority Data

Aug. 12, 2013 (JP) ..... 2013-167234

(51) Int. Cl.
*B65H 39/16* (2006.01)
*B42C 9/00* (2006.01)
(Continued)

(52) U.S. Cl.
CPC ..... *B65H 39/16* (2013.01); *B41F 13/54* (2013.01); *B41F 13/56* (2013.01); *B41F 13/58* (2013.01);
(Continued)

(58) Field of Classification Search
CPC ..... B65H 35/02; B65H 35/04; B65H 35/0006; B65H 37/00; B65H 37/02; B65H 37/04; B65H 37/06; B65H 39/16; B42C 9/0081; B41J 11/70; B41F 13/54; B41F 13/56; B41F 13/58; B41F 13/60
(Continued)

(56) References Cited

U.S. PATENT DOCUMENTS 4,939,888 A * 7/1990 Katz ..... B31B 41/00 270/4
6,048,152 A * 4/2000 Koyama ..... B41F 17/02 412/16
(Continued)

FOREIGN PATENT DOCUMENTS

JP 2002086966 A 3/2002
JP 2006321148 A 11/2006
JP 2011110814 A 6/2011

OTHER PUBLICATIONS

Extended European Search Report dated Dec. 4, 2014 issued in counterpart European Application No. 14179136.8.

*Primary Examiner* — Leslie A Nicholson, III
(74) *Attorney, Agent, or Firm* — Holtz, Holtz & Volek PC

(57) ABSTRACT

A booklet making method includes: cutting a web of paper on one side and on another side into first and second continuous sheets, alternately bonding the first and second continuous sheets widthwise with a setting paste and a throwaway paste to form a double set continuous sheet of paper, and cutting the double set continuous sheet of paper into split double sheets of a selected longitudinal length. A plurality of split double sheets is integrally bound with an integrating paste to form a booklet-like product. Portions of the booklet-like product which are pasted and bonded with the throwaway paste are cut off to provide a plurality of booklets. Thus, by the booklet making method, booklets having an odd number of leaves or pages are formed without waste of paper and with reduced paper jams.

3 Claims, 12 Drawing Sheets

(51) Int. Cl.

| | |
|---|---|
| ***B41J 11/70*** | (2006.01) |
| ***B42C 19/06*** | (2006.01) |
| ***B65H 35/02*** | (2006.01) |
| ***B65H 37/02*** | (2006.01) |
| ***B41F 13/54*** | (2006.01) |
| ***B65H 35/00*** | (2006.01) |
| ***B65H 35/04*** | (2006.01) |
| ***B65H 37/04*** | (2006.01) |
| ***B41F 13/56*** | (2006.01) |
| ***B41F 13/58*** | (2006.01) |
| ***B65H 37/00*** | (2006.01) |
| ***B65H 37/06*** | (2006.01) |
| ***B41F 13/60*** | (2006.01) |
| ***B65H 29/40*** | (2006.01) |
| ***B65H 29/60*** | (2006.01) |
| ***B65H 33/14*** | (2006.01) |
| ***B65H 39/10*** | (2006.01) |
| ***B65H 39/115*** | (2006.01) |
| *B26D 7/00* | (2006.01) |

(52) U.S. Cl.

CPC ..... *B41F 13/60* (2013.01); *B41J 11/70* (2013.01); *B42C 9/0081* (2013.01); *B42C 19/06* (2013.01); *B65H 29/40* (2013.01); *B65H 29/60* (2013.01); *B65H 33/14* (2013.01); *B65H 35/0006* (2013.01); *B65H 35/02* (2013.01); *B65H 35/04* (2013.01); *B65H 37/00* (2013.01); *B65H 37/02* (2013.01); *B65H 37/04* (2013.01); *B65H 37/06* (2013.01); *B65H 39/10* (2013.01); *B65H 39/115* (2013.01); *B26D 2007/0081* (2013.01); *B65H 2301/42112* (2013.01); *B65H 2301/5151* (2013.01); *B65H 2301/5155* (2013.01); *B65H 2701/1829* (2013.01)

(58) Field of Classification Search

USPC 270/5.01, 5.02, 16, 37, 52.07, 52.09; 412/8, 16, 37

See application file for complete search history.

(56) References Cited

U.S. PATENT DOCUMENTS

| | | | | |
|---|---|---|---|---|
| 6,821,038 | B2 * | 11/2004 | Izawa | B26D 9/00 101/224 |
| 7,469,887 | B2 * | 12/2008 | Romita | B41F 13/58 270/21.1 |
| 7,661,359 | B2 * | 2/2010 | Eckert | B41F 13/58 101/226 |
| 7,963,515 | B2 * | 6/2011 | Dawley | B41F 13/58 270/52.09 |
| 8,353,505 | B2 | 1/2013 | Kaneko et al. | |
| 2005/0116461 | A1 | 6/2005 | Katz et al. | |
| 2005/0120607 | A1 | 6/2005 | Austin | |
| 2013/0084146 | A1 * | 4/2013 | Speller | B42C 9/0006 412/37 |

* cited by examiner

BOOKLET MAKING METHOD AND APPARATUS

BACKGROUND OF THE INVENTION

Technical Field

The present invention relates to a method of and apparatus for making a booklet or booklets from a printed web of paper.

Description of the Prior Art

There has hitherto been proposed a variety of methods of making a booklet or booklets from a web of paper or a continuous sheet of paper.

For example, JP 2002-86966 A discloses a booklet making method in which a continuous sheet of paper having a paste applied thereto is cut into split sheets of a length of a booklet and the sheets are transported and piled one on another. The sheets while in a pile are bonded and bound together with the binding paste to provide a booklet of a selected number of sheets.

JP 2011-110814 A discloses a booklet making method in which a web of paper is cut centrally of its width into a continuous sheet of paper on one side and a continuous sheet of paper on the other side. The continuous sheet of paper on one side having a paste applied thereto at its binding side and the continuous sheet of paper on the other side are laid one on top of the other to form a double continuous sheet of paper. The double continuous sheet of paper is cut into split sheets of a selected length which are transported and piled to form booklets.

JP 2006-321148 A discloses a booklet making method in which a continuous sheet of paper is cut centrally of its width into a pair of rows which are shifted from each other in transport-wise position and superposed one above the other. The top and bottom sheets of paper are alternately cut successively into split sheets. Having a paste applied thereto, the split sheets are piled into booklets having an odd number or an even number of leaves (pages) or having them randomly mixed.

The booklet making method described in JP 2002-86966 A, in which split sheets cut from a continuous sheet of paper is transported on by one, such sheets while in transport lack firmness and tend to deviate in position, raising the problem that when piled to form booklets, they are apt to become uneven in position and the problem that they in transport tends to cause a paper jam.

In the booklet making method described in JP 2011-110814 A in which split sheets are transported which are formed by cutting a continuous sheet of paper on one side and a continuous sheet of paper on the other side that are laid one on the other, the double sheets gain firmness and less deviates in position. The sheets when piled to form booklets are bettered in evenness of position and their jam in transport is reduced. Since, however, booklets are fabricated on the basis of two continuous sheets of paper superposed, the booklets that can be fabricated will have to be of an even number of leaves. When a booklet of an odd number of leaves is made, a sheet which is essentially unnecessary must be included, bringing about the problem that waste of paper is caused.

While such a sheet that is essentially unnecessary may be utilized as memo or scratch paper, it is unnecessary as a leaf of booklets and becomes waste of paper.

In the booklet making method described in JP 2006-321148 A in which split sheets formed by cutting a continuous sheet of paper is transported one by one, the sheets in transport lack firmness and tend to deviate in position, giving rise to the problem that a plurality of such sheets when piled to form booklets are apt to become uneven in position and the problem that they in transport tends to cause a paper jam.

Made in view of the problems mentioned above, the present invention has for its object to provide a booklet making method and apparatus whereby sheets in forming booklets can be evenly set and their jam in transport is reduced and whereby a booklet having an odd number of leaves or pages can be formed without waste of paper.

SUMMARY OF THE INVENTION

There is provided in accordance with the present invention, a booklet making method in a first mode of implementation thereof which comprises the steps of:

- cutting a web of paper having a plurality of printed booklet page sections which in its transport direction are spaced apart from one another, on each of its widthwise one and other sides, into a first and a second continuous sheet of paper on the widthwise one and other sides;
- laying the first and second continuous sheets of paper one on the other, and forming a double set continuous sheet of paper by bonding widthwise one side edges of a pair of overlapping such booklet page sections together with a throwaway paste and bonding widthwise other side edges of a next adjacent pair of such overlapping booklet page sections together with a setting paste;
- cutting the double set continuous sheet of paper into split double sheets comprising pairs of sheets having such pairs of overlapping booklet page sections;
- laying the split double sheets one on another and bonding widthwise other side edges of adjacent sheets of adjacent two of the said split double sheets together with an integrating paste, thereby forming a booklet-like product comprising an odd number of sheets and an even number of sheets both of which are individually bound at the widthwise other side edges; and
- cutting off those edge portions of the split double sheets which are bonded with the throwaway paste, thereby forming a plurality of booklets which comprise the sheets of the page sections.

The present invention also provides a booklet making method in a second mode of implementation thereof which comprises the steps of:

- cutting a web of paper having a plurality of printed booklet page sections, which in its transport direction are spaced apart from one another, on each of its widthwise one and other sides, into a first and a second continuous sheet of paper on the said widthwise one and other sides;
- laying the first and second continuous sheets of paper one on the other, and forming a double set continuous sheet of paper by bonding widthwise one side edges of a pair of overlapping such booklet page sections together with a throwaway paste and bonding widthwise other side edges of a next adjacent pair of such overlapping booklet page sections together with a setting paste;
- cutting the double set continuous sheet of paper into split double sheets comprising pairs of sheets having such pairs of overlapping booklet page sections;
- laying the split double sheets one on another and binding adjacent sheets thereof together for an odd number of such sheets at a widthwise other side edge with an integrating paste to form a group of such odd numbers of sheets so bound together, thereby forming a booklet-like product comprising such groups piled one on another; and cutting off a widthwise one side edge of the booklet-like product, thereby separating portions of the split double sheets which are bonded with the throwaway paste to form a plurality of booklets which comprise the sheets of the page sections.

The present invention also provides a booklet making apparatus which comprises a first cutting means for cutting a web of paper into a first and a second continuous sheet of paper on its widthwise one and other sides, a side edge truing-up means for truing up the first and second continuous sheets of paper to bring them into coincidence with each other in side edge, a pasting means, a superposing means for laying the first and second continuous sheets of paper one on top of another to form a double set continuous sheet of paper, a second cutting means for cutting the double set continuous sheet of paper into a plurality of split double sheets, a piling means for laying the split double sheets one on top of another and causing them to be bonded together to form a booklet-like product, and a trimming means for cutting off unnecessary portions of the booklet-like product to form a plurality of booklets therefrom, wherein the pasting means comprises a double sheet setting pasting member for pasting a plurality of widthwise other side edge portions of the first continuous sheet of paper, a throwaway pasting member for pasting a plurality of widthwise one side edge portions of the first continuous sheet of paper with a throwaway paste, and an integrating pasting member for pasting widthwise other side edge portions of the second continuous sheet of paper with an integrating paste, and the trimming means is adapted to cut off portions of the booklet-like product which are pasted and bonded with the throwaway paste.

According to the first and second modes of booklet making method of the present invention in which split double sheets are transported that are cut from a double set continuous sheet of paper formed from a continuous sheet of paper on one side and a continuous sheet of paper on the other side of a continuous web of paper which are laid one on top of the other and bonded together alternately at widthwise other side edge portions of a pair of overlapping page sections and at widthwise one side edge portions of a next pair of overlapping page sections, the sheets in transport secure firmness and less turn aside in position, ensuring that the sheets in forming booklets are evenly set in position and their jam in transport is reduced.

Moreover, a booklet having an odd number of leaves or pages can be formed without waste of paper.

According to the first mode of booklet making method of the present invention, booklets can continuously be prepared which include a booklet having an odd numbers of leaves and a booklet having an even number of leaves mixed as desired.

According to the second mode of booklet making method of the present invention, booklets can be produced which individually have an odd number of leaves.

BEST MODES FOR CARRYING OUT THE INVENTION

Figure 1:
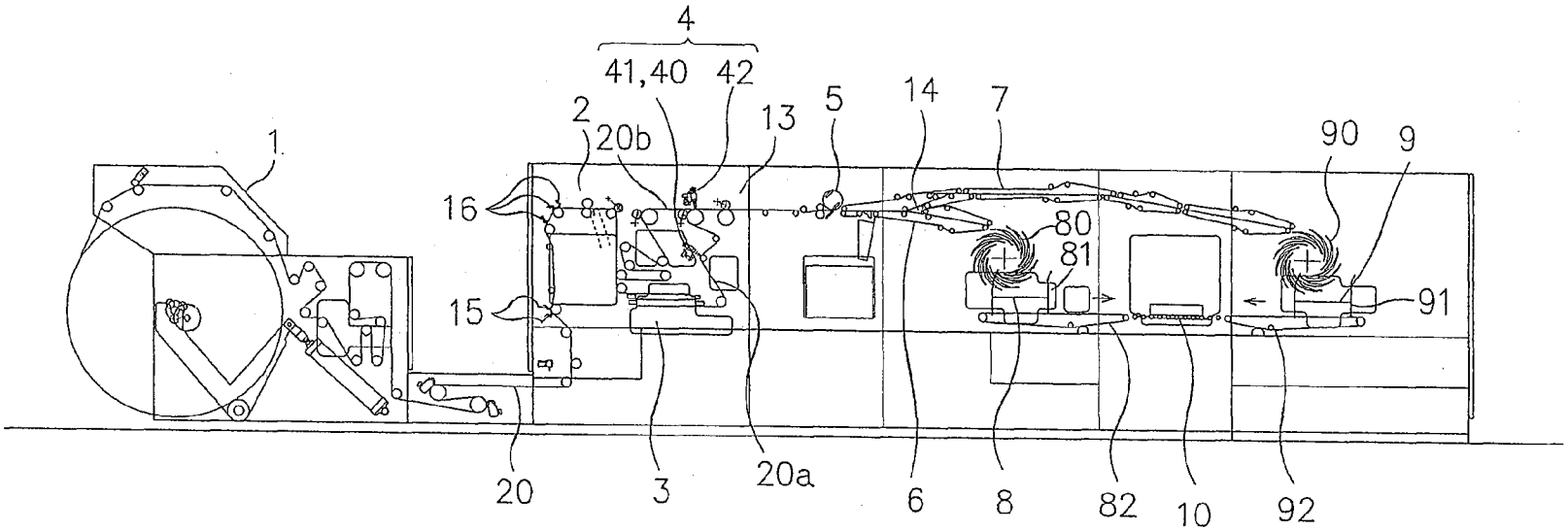
FIG. 1 is a schematic front view of a booklet making apparatus according to the present invention.
Figure 2:
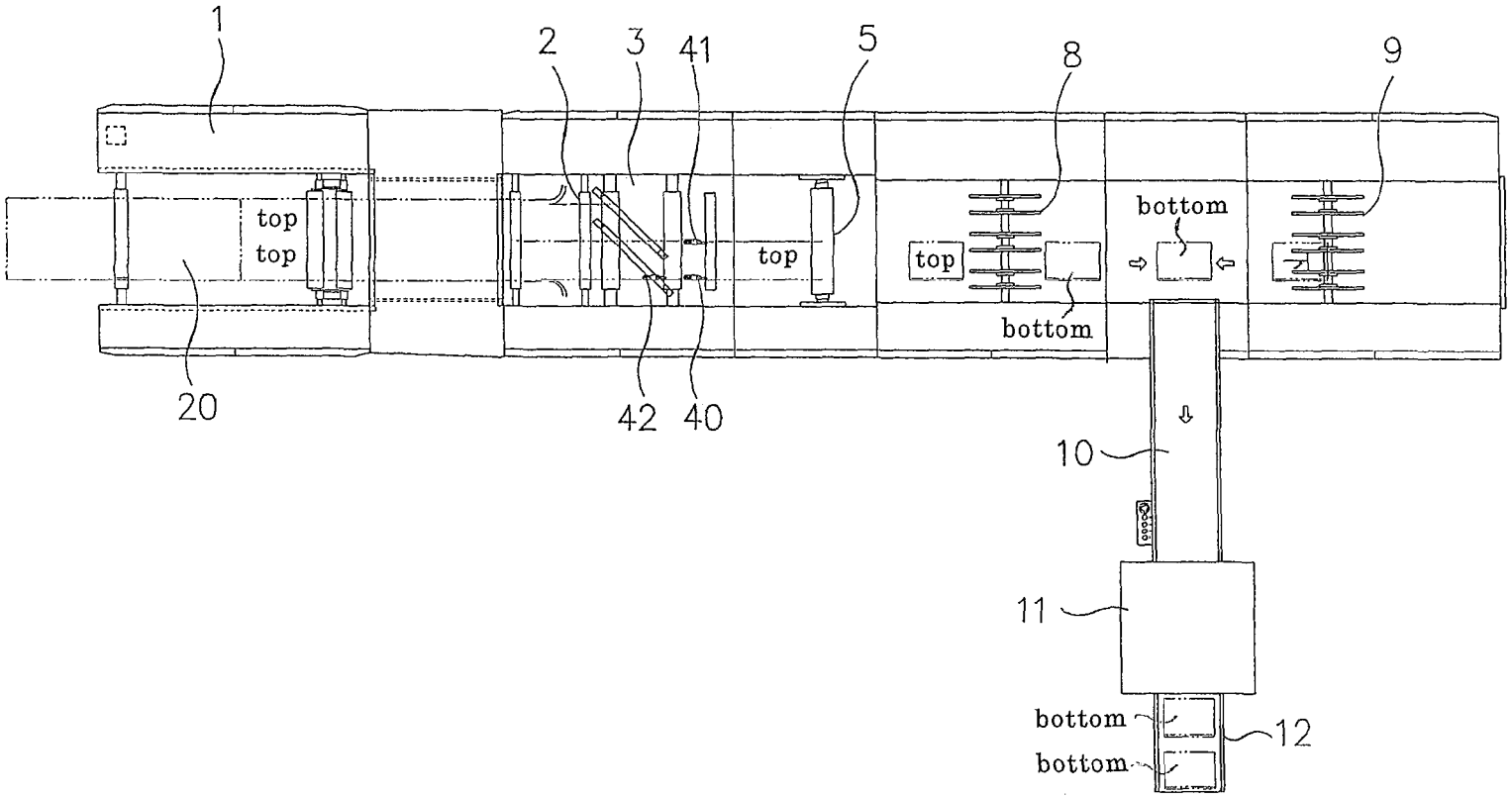
FIG. 2 is a schematic top plan view of the booklet making apparatus shown in FIG. 1.

Explanation is schematically given of a booklet making apparatus according to the present invention with reference to FIGS. 1 and 2 which are schematic front and top plan views of the apparatus, respectively.

The booklet making apparatus as shown is provided with a paper supply unit 1, a first cutting unit 2, a side edge truing-up unit 3, a pasting unit 4, a second cutting unit 5, a first transport unit 6, a second transport unit 7, a first piling unit 8, a second piling unit 9, a booklet transport unit 10, a trimming unit 11 and a finish booklet delivery unit 12.

In FIG. 2, however, those such as the first and second transport units 6 and 7 are omitted from illustration.

The paper supply unit 1 feeds a web of paper 20 towards the first cutting unit 2.

Figure 3:
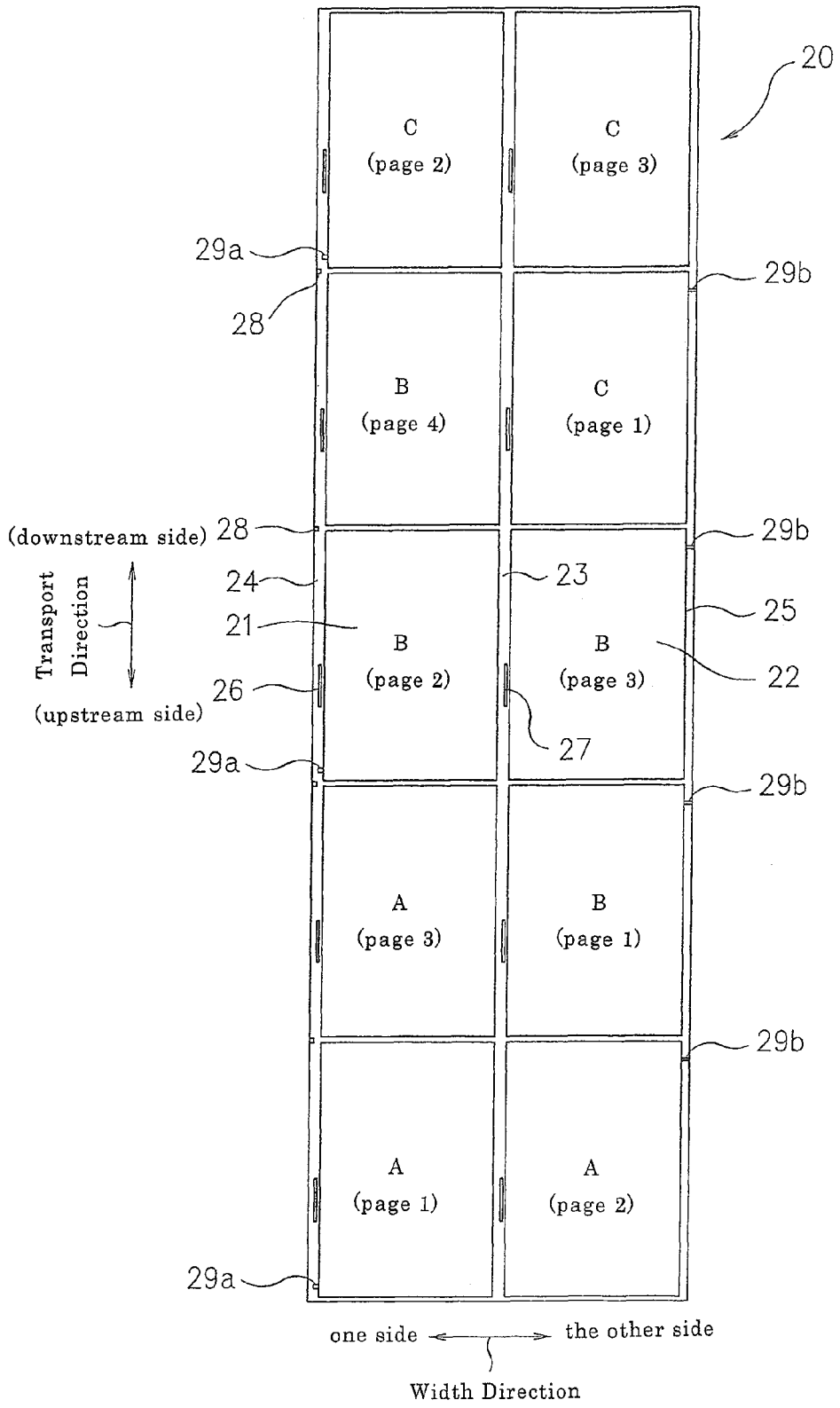
FIG. 3 is a top plan view of a punted web of paper for illustrative use in a booklet making method of the present invention that can be carried out in the booklet making apparatus shown in FIGS. 1 and 2.

The web of paper 20 as shown in FIG. 3 is preprinted and is provided with a first series of printed sections 21 on one side and a second series of printed sections 22 on the other side across a center line of its width direction orthogonal to the transport direction of the web of paper 20 (its longitudinal direction). The successive printed sections 21, 22 on each of both sides of the web of paper 20 are spaced apart from one another in its transport direction. The printed sections on one side 21 and those on other side 22 are identical in longitudinal length, each constituting a page of a booklet or booklets.

The printed sections on one side 21 and the printed sections on other side 22 have each a width smaller than half the width of web of paper 20. The continuous web of paper 20 is thus provided with an intermediate blank area 23 between the first series of printed sections on one side 21 and the second series of printed sections on other side 22, a blank area on one side 24 closer to one side edge than the first series of printed sections on one side 21 and an blank area on other side 25 closer to the other side edge than the second series of printed sections on other side 22.

The blank area on one side 24 is provided with a basic barcode on one side 26 for recognition such as of printed information for a printed section on one side 21 and information of the booklet(s).

The intermediate blank area 23 is provided with a basic barcode on other side 27 for recognition of such as printed information for a printed section on other side 22 and leaf information of the booklet(s).

A cutting mark 28 is also provided between printed sections adjacent in the transport direction.

Further, the blank area on one side 24 is provided with a first pasting mark 29*a* and the blank area on other side 25 is provided with a second pasting mark 29*b*.

A path of travel between the paper supply unit 1 and the first cutting unit 2 is provided with a first mark sensor 15 for reading out the basic barcode on one side 26 and the first pasting mark 29*a* and with a second mark sensor 16 for reading out the basic barcode on other side 27 and the second pasting mark 29*b*.

Figure 4:
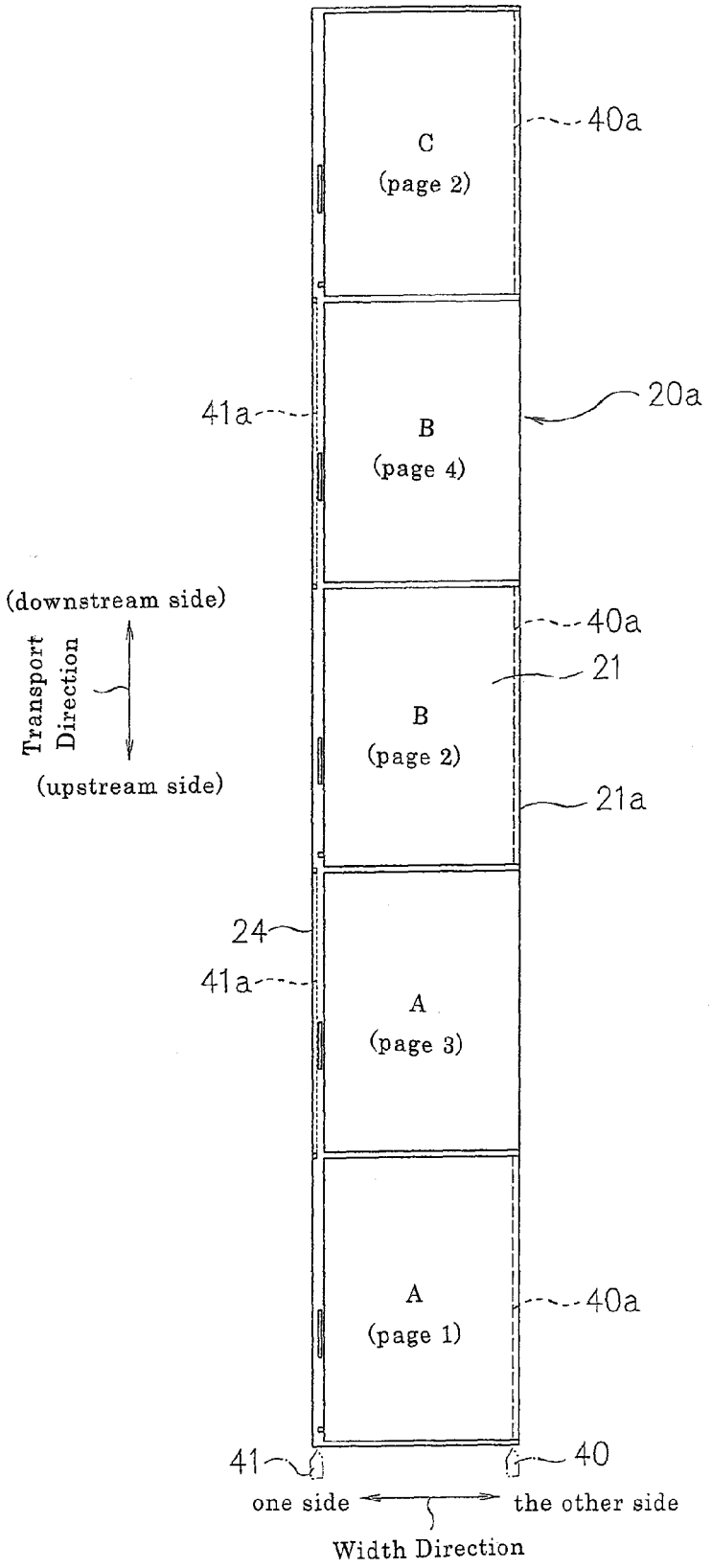
FIG. 4 is a top plan view of a first printed continuous sheet of paper on one side parted from the web of paper shown in FIG. 3.
Figure 5:
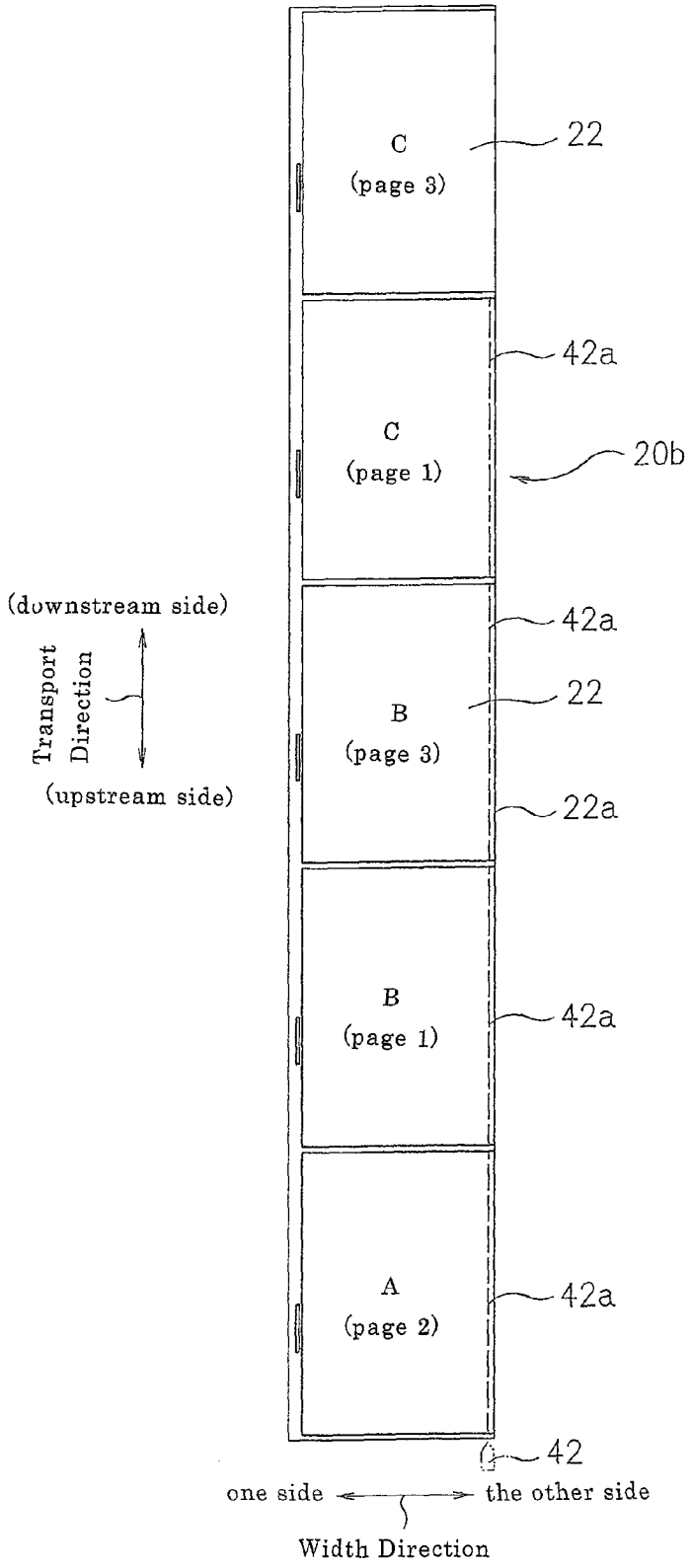
FIG. 5 is a top plan view of a second printed continuous sheet of paper on the other side parted from the web of paper of FIG. 3.

The first cutting unit 2 is designed to cut with a central slitter, the web of paper 220 along its widthwise middle (along the intermediate blank area 23 aforesaid) continuously in its transport direction and to widthwise divide it into a first continuous sheet of paper 20*a* on one widthwise side as shown in FIG. 4 and a second continuous sheet of paper 20*b* on the other widthwise side as shown in FIG. 5.

In the first continuous sheet of paper on one side 20*a* there exist the printed sections on one side 21 and in the second continuous sheet of paper on other side 20*b* there exist the printed sections on other side 22.

The first cutting unit 2 cuts off with the central slitter, an excess other side area of the first continuous sheet of paper on one side 20*a* from the other side edge 21*a* of the printed sections on one side 21 so that the other side edge of the first continuous sheet of paper on one side 20*a* becomes the other side edge of booklet leaves or pages (see FIG. 4).

At the same time, it cuts off with a side slitter, an excess other side area of the second continuous sheet of paper on other side 20*b* from the other side edge 22*a* of the printed sections on other side 22 so that the other side edge of the second continuous sheet of paper on other side 20*b* becomes the other side edge of booklet leaves or pages (see FIG. 5).

Figure 6:
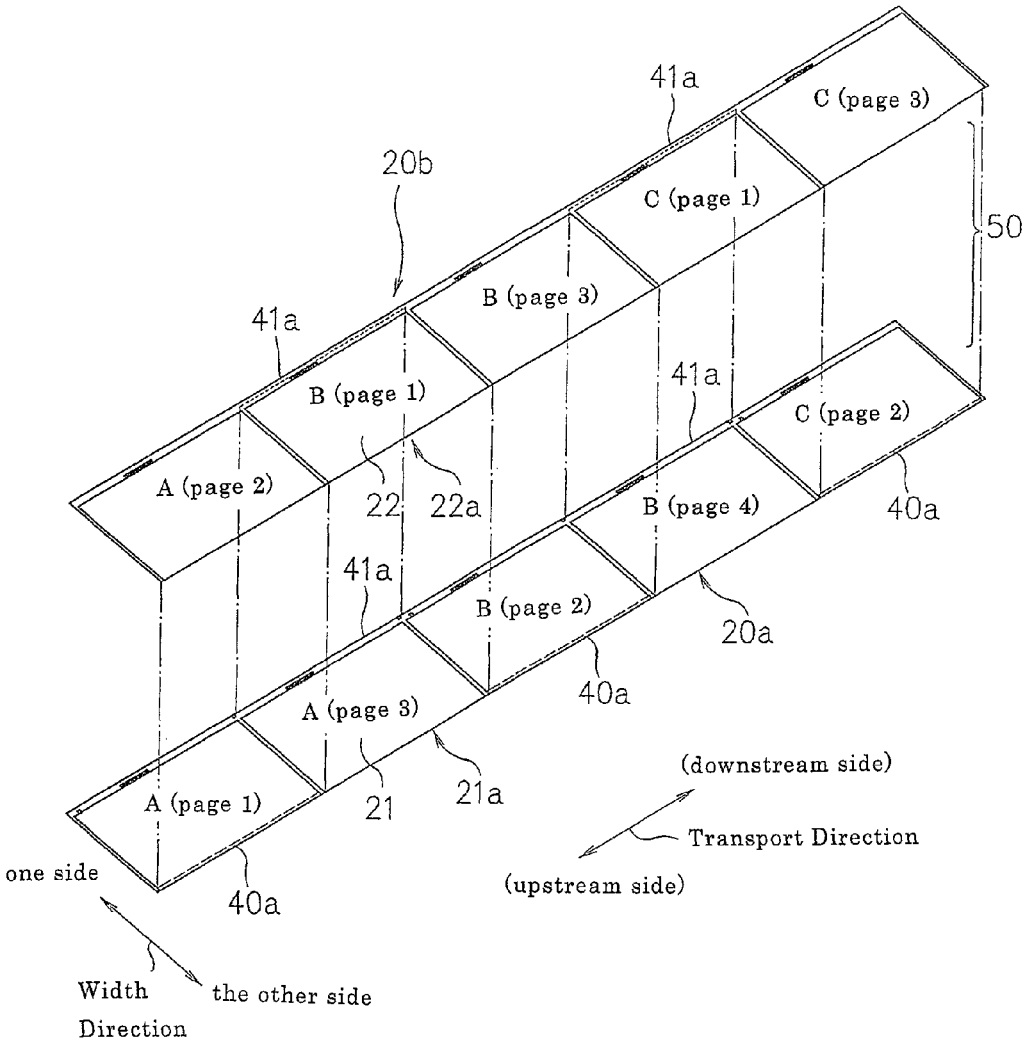
FIG. 6 is a perspective view of the second printed continuous sheet of paper on the other side and the first printed continuous sheet of paper on one side trued up under the second printed continuous sheet of paper on the other side.

The side edge truing-up unit 3 is provided at a site downstream of the first cutting unit 2. The side edge truing-up unit 3 has a pair of turning bars and as shown in FIG. 6 moves the first continuous sheet of paper 20*a* widthwise to bring it under and into coincidence in side edge with the second continuous sheet of paper 20*b*.

The first and second continuous sheets of paper 20*a* and 20*b* whose side edges are trued up are pasted in the pasting unit 4 and thereafter transported towards the superposing unit 13 disposed upstream of the second cutting unit 5.

The pasting unit 4 is provided in a path of travel of the first continuous sheet of paper 20*a* between the truing-up unit 3 and the superposing unit 13 with a double sheet setting pasting member, e.g. a double sheet setting pasting nozzle 40, and a throwaway pasting member, e.g. a throwaway pasting nozzle 41, spaced apart from the pasting nozzle 40, and has an integrating pasting member, e.g. an integrating pasting nozzle 42, in a path of travel of the second continuous sheet of paper 20*b*.

The double sheet setting pasting nozzle 40 as shown by one phantom line in FIG. 4 is opposed to an area of the widthwise other side edge of a said first printed section 21 on the first continuous sheet of paper 20*a* to apply a spray of setting paste 40*a* to that area for pasting.

The throwaway pasting nozzle 41 as shown in the other phantom line in FIG. 4 is opposed to a portion of the blank area on one side 24 closer to the widthwise one side edge than a said first printed section 21 of the first continuous sheet of paper 20*a* to apply a spray of throwaway paste 41*a* to that portion of one side blank area 24 for pasting.

The integrating pasting nozzle 42 as shown in the phantom line in FIG. 5 is opposed to a portion closer to the widthwise other side of a said second printed section 22 on the second continuous sheet of paper 20*b* to apply a spray of integrating paste 42*a* to that portion for pasting.

Figure 7:
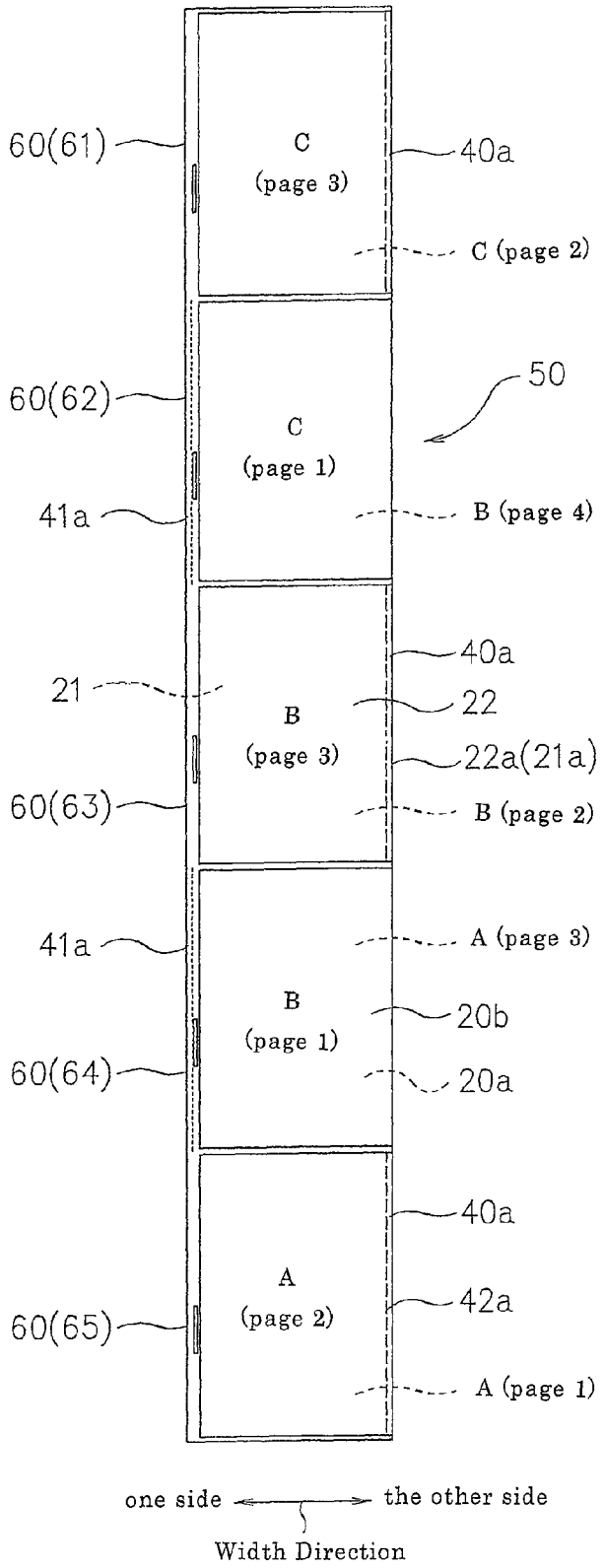
FIG. 7 is a top plan view of a double set printed continuous sheet of paper formed from the first and second continuous sheets of paper of FIG. 6.

The superposing unit 13 as shown in FIGS. 6 and 7 lays the second continuous sheet of paper 20*b* on top of the first continuous sheet of paper 20*a* and has them bonded together by the setting and throwaway pastes 40*a* and 41*a* to form a double set continuous sheet of paper 50.

In the second cutting unit 5, the double set continuous sheet of paper 50 shown in FIG. 7 is cut into split double sheets 60 of a selected longitudinal length. Each of the split double sheets 60 are made up of single sheets comprising portions of the first and second continuous sheet of paper 20*a* and 20*b* and bonded together.

For example, the double set continuous sheet of paper 50 is cut at positions of the cutting marks 28 to form a first to a fifth split double sheet 61 to 65.

Figure 8:
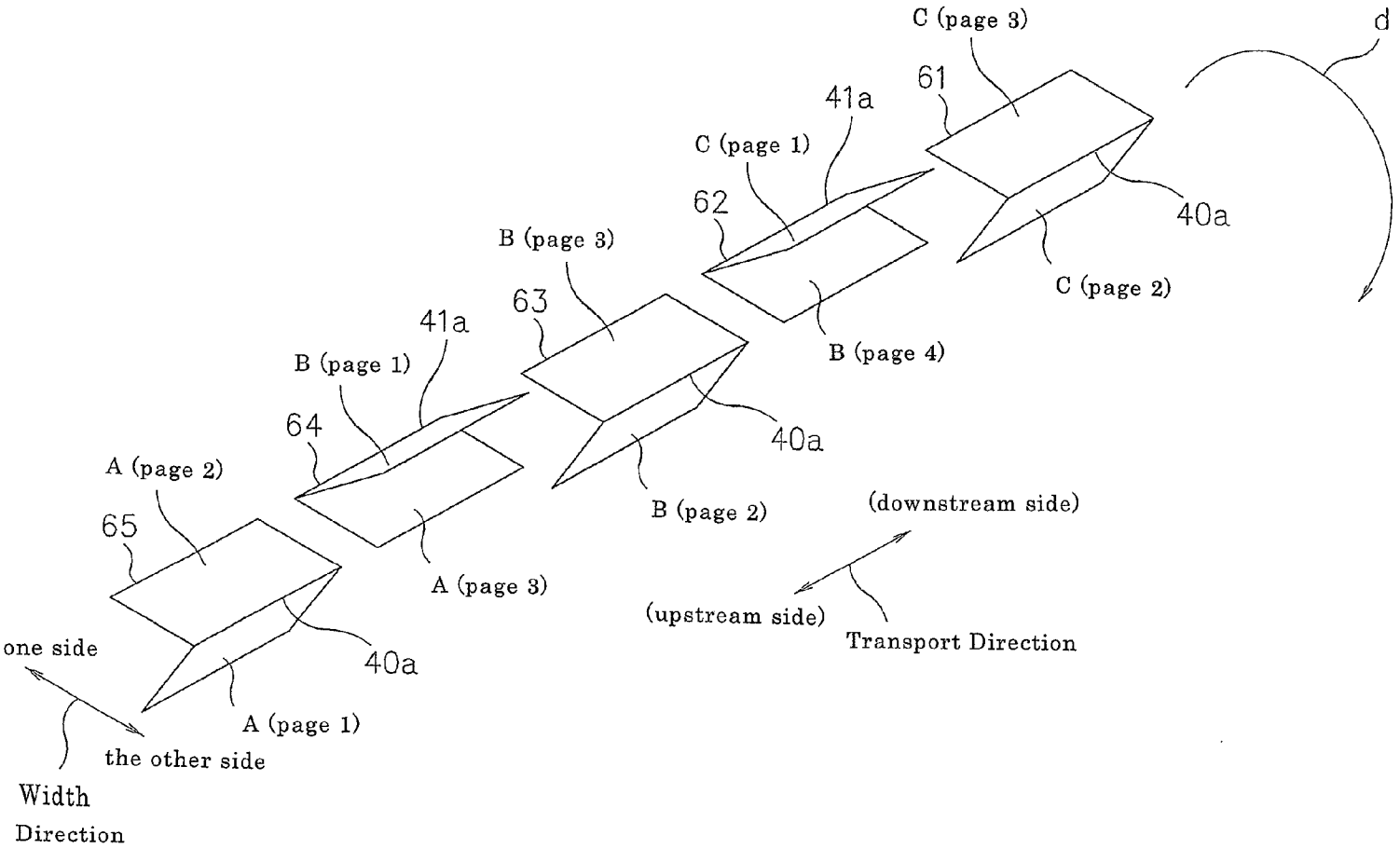
FIG. 8 is a perspective view illustrating a first to a fifth split double sheet cut from the double set continuous sheet of paper of FIG. 7.

As shown in FIG. 8, the first, third and fifth split double sheets 61, 63 and 65 have their widthwise other side edges bonded with the setting paste 40*a* while the second and fourth split double sheets 62 and 64 have their widthwise one side edges bonded with the throwaway paste 41*a*.

The first and second transport units 6 and 7 are each constituted of a transport conveyer whereby split double sheets 60 and subsequent split double sheets 60, each having two sheets of paper bonded together and which are spaced apart, are transported to the first and second piling units 8 and 9, respectively.

Increased thus in firmness, the split double sheets 60 are transported on the first and second transport units 6 and 7 to reach the first and second piling units 8 and 9 without deviating in position and are set evenly in forming booklet-like products in the piling units 8 and 9. Further, jam is reduced as well.

Figure 9:
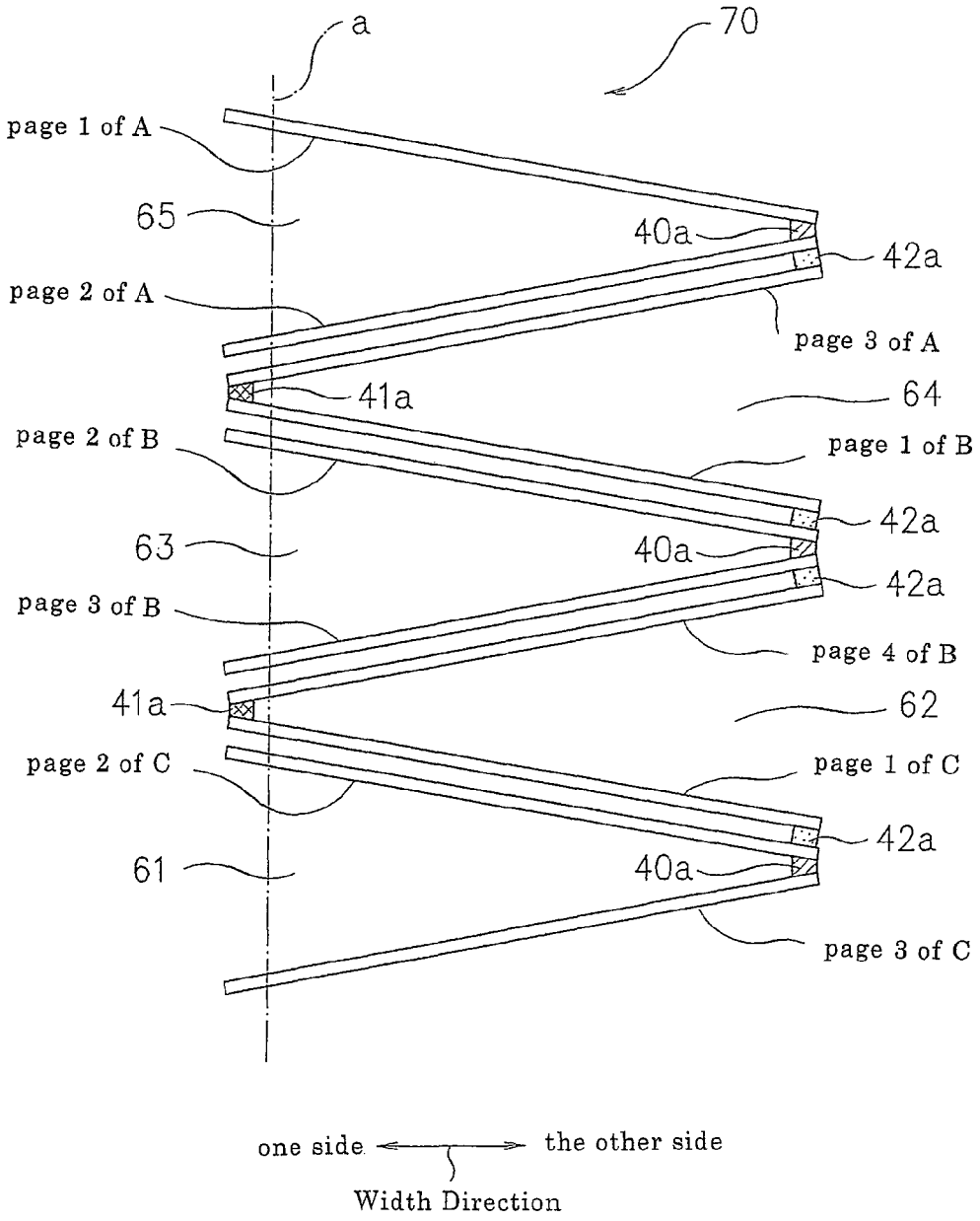
FIG. 9 is an explanatory view illustrating a booklet-like product in which split double sheets are pasted up alternately at widthwise one and other side edges.

The first and second piling units 8 and 9 comprise vane wheels 80 and 90 that receive incoming split double sheets 60 one by one, frame members 81 and 91 that successively collect and pile the split double sheets received by the vane wheels 80 and 90, and belt conveyers 82 and 92 that constitute base plates of the frame members 81 and 91, respectively. A plurality of split double sheets 60 are thus piled and bonded with the integrating paste 42*a* to form a booklet-like product 70 as shown in FIG. 9. Such booklet-like products 70 are alternately transported by the belt conveyers to the booklet transport unit 10.

The booklet transport unit 10 transports the booklet-like products 70 to the trimming unit 11.

Figure 10:
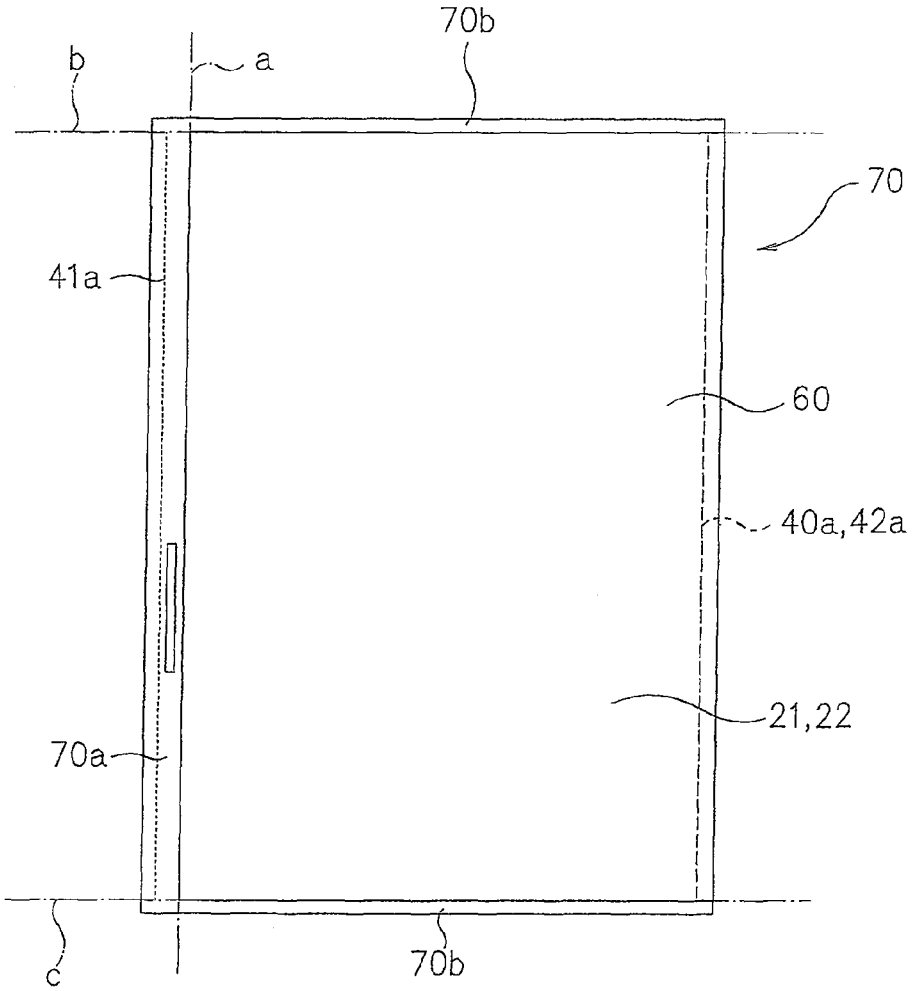
FIG. 10 is an explanatory view of an operation of trimming the booklet-like product.

The cutting unit 11 as shown in FIG. 10 cuts off portions of widthwise one side 70*a* of a booklet-like product 70 (portions of split double sheets 60 bonded with the throwaway paste) and portions of longitudinal both sides 70*b*, along three lines of cut a, b and c in conformity with the size of the first and second printed sections 21 and 22. A booklet 80 is thereby formed having a plurality of split double sheets of a selected size bound together and such a plurality of split double sheet 60 left bonded together along their widthwise other side portions with the setting paste and integrating paste 40*a* and 42*a*.

The finish booklet delivery unit 12 ejects and delivers booklets 80 each having its three sides properly finish-cut with the trimming unit 11.

Described above, the booklet making method thus enables fabricating both a booklet of leaves of an odd number and a booklet of leaves of an even number without bringing about waste of paper.

Explanation is next given of a method of making a booklet A of an odd number (3) of pages (leaves), a booklet B of an even number (4) of pages and a booklet C of an odd number (3) of pages successively.

As shown in FIG. 3, a printed web of paper 20 is prepared having printed sections on one side 21 which are designed in turn from the upstream side in the transport direction of the web of paper 20 to constitute the 1st page (leaf) of booklet A, the 3rd page of the booklet A, the 2nd page of booklet B, the 4th page of the booklet B and the 2nd page of booklet C. The printed web of paper 20 also has a first pasting mark 29*a* printed at each of portions of blank areas on one side 24 adjacent to every other printed sections on one side 21 and a second pasting mark 29*b* printed at each of portions of blank areas on other side 25 adjacent to printed sections on other side 22 other than a downstream-most printed section on other side 22.

The printed sections on other side 22 of the web 20 are designed in turn to constitute, from the upstream side of its transport, the 2nd page of the booklet A, the 1st page of the booklet B, the 3rd page of the booklet B, the 1st page of booklet C and the 3rd page of the booklet C.

Note here that printed sections on one side 21 and printed sections on other side 22 may be provided not only on the front face but also on the back face of the continuous web of paper 20.

The web of paper 20 is cut in the first cutting unit 2 to form a first continuous sheet of paper on one side 20*a* and a second continuous sheet of paper on other side 20*b*.

Widthwise other side edge portions of the first continuous sheet of paper on one side 20*a*, i.e. those of the printed sections 21 for the 1st page of the booklet A, the 2nd page of the booklet B and the 2nd page of the booklet C, are pasted with the setting paste 40*a*. Also, its widthwise one side blank portions 24, i.e. those of the printed sections 21 for the 3rd page of the booklet A and the 4th page of the booklet B, are pasted with the throwaway paste 41*a*.

In this pasting operation, the double sheet setting pasting nozzle 40 is operated for a preset time period in response to a signal from the first mark sensor 15 sensing a first pasting mark 29*a* to spray and thereby apply the setting paste 40*a* and thereafter to cease spraying operation, whereafter the throwaway pasting nozzle 41 is operated for a preset time period to spray and thereby apply the throwaway paste 41*a*.

Specifically, timings to operate the double sheet setting pasting nozzle 40 and the throwaway pasting nozzle 41 for spraying the setting paste 40*a* and the throwaway paste 41*a*, respectively, are determined by detecting such marks with the first mark sensor 15. The nozzles 40 and 41 are operated at such timings of spraying operations.

A widthwise other side edge area of the second continuous sheet of paper on other side 20*b*, which are for pages other than the 3rd page of the booklet C at its downstream-most, i.e. for the 1st page of the booklet C, the 3rd page of the booklet B, the 1st page of the booklet B and the 2nd page of the booklet A, is pasted with the integrating paste 42*a*.

In this pasting operation, the integrating pasting nozzle 42 is operated in response to signals of the second mark sensor 16 sensing the second pasting marks 29*b* to apply sprays of the integrating paste 42*a* to the area.

The first continuous sheet of paper on one side 20*a* and the second continuous sheet of paper on other side 20*b* each of which has been pasted are superposed and bonded together in the superposing unit 13 to form a double set continuous sheet of paper 50.

The double set continuous sheet of paper 50 is bonded together as follows:

Of the first continuous sheet of paper on one side 20*a* and the second continuous sheet of paper on other side 20*b* as shown in FIGS. 6 and 7, the widthwise other side edges for the 1st page of the booklet A and the 2nd page of the booklet A are bonded together with the setting paste 40*a*.

Their widthwise one side edges (edge blank portions) for the 3rd page of the booklet A and the 1st page of the booklet B are bonded together with the throwaway paste 41*a*.

Their widthwise other side edges for the 2nd page of the booklet B and the 3rd page of the booklet B are bonded together with the setting paste 40*a*.

Their widthwise one side edges (edge blank portions) for the 4th page of the booklet B and the 1st page of the booklet C with the throwaway paste 41*a* are bonded together.

Their widthwise other side edges for the 2nd page of the booklet C and the 3rd page of the booklet C with the setting paste 40*a* are bonded together.

In other words, the sheets of the double set continuous sheet of paper 50 are bonded alternately at widthwise one and other side edge portions of the printed sections 21 and 22 becoming booklet pages or constituting booklet leaves, with respect to the transport direction.

The double set continuous sheet of paper 50 is cut in the second cutting unit 5 into a first, a second, a third, a fourth and a fifth split double sheet 61, 62, 63, 64 and 65 as indicated from downstream to upstream in the sheet transport direction.

As shown in FIG. 8, each of the first, third and fifth split double sheets 61, 63 and 65 has their sheets bonded at the widthwise other side edge portions and not bonded at the widthwise one side edge portions and is left open to its widthwise one side. Each of the second and fourth split double sheets 62 and 64 has their sheets bonded at the widthwise one side edge portions and not bonded at the widthwise other side edge portions and is left open to its widthwise other side.

The first to fifth split double sheets 61 to 65 are transported as they are spaced apart from each other by the first transport unit 6 towards the first piling unit 8 in which they are piled into a booklet-like product 70.

The first to fifth split double sheets 61 to 65 in a next series are transported as they are spaced apart from each other by the second transport unit 7 towards the first piling unit 9 in which they are piled to form a booklet-like product 70.

To wit, as the five printed sections 21, 22 are continuously printed on each of one and the other sides of a continuous web of paper 20 and the first to fifth split double sheets 61 to 65 are continuously prepared in succession, the first and second transport units 6 and 7 can be adapted to convey them alternately.

For example, the first and second transport units 6 and 7 are provided at their inlet with a switching means, e.g. a switching gripper that can be oscillated so that the first to fifth split double sheets 61-65 may be transported selectively by the first or second transport unit 6 and 7.

With reference to FIGS. 8 and 9, mention is made of an operation of forming a booklet-like product 70 by piling the first to fifth split double sheets 61 to 65.

The first split double sheet 61 transported with the 2nd page of the booklet C downside and the 3rd page of the booklet C upside is turned upside down as shown by arrow d by a rotation of the vane wheel 80 (90) so that the first split double sheet 61 when placed on the belt conveyer 82 (92) has the 2nd page of the booklet C laid up and the 3rd page of the booklet C laid down.

Next, the second split double sheet 62 is turned upside down so that its 1st page of the booklet C is laid on the 2nd page of the booklet C of the first split double sheet 61. Then, the 2nd page of the booklet C of the first split double sheet 61 and the 1st page of the booklet C of the second split double sheet 62 are bonded together at their widthwise other side edge portions with the integrating paste 42*a*.

Next, the third split double sheet 63 is turned upside down and is piled on the second split double sheet 62. The 4th page of the booklet B of the second split double sheet 62 and the 3rd page of the booklet B of the third split double sheet 63 are bonded together at their widthwise other side edge portions with the integrating paste 42*a*.

Further, the fourth split double sheet 64 is turned upside down and is piled on the third split double sheet 63. The 2nd page of the booklet B of the third split double sheet 63 and the 1st page of the booklet B of the fourth split double sheet 64 are bonded together at their widthwise other side edge portions with the integrating paste 42*a*.

Finally, the fifth split double sheet 65 is turned upside down and is piled on the fourth split double sheet 64. The 3rd page of the booklet A of the fourth split double sheet 64 and the 2nd page of the booklet B of the fifth split double sheet 65 are bonded together at their widthwise other side edge portions with the integrating paste 42*a*.

A booklet-like product 70 is thus formed comprising the booklets A, B and C superposed one on another.

In this form of implementation of the invention, superposing split double sheets one on another upon turning each of them upside down allows pasting an integrating paste 42*a* on an upper face of a split double sheet (an upper face of a continuous sheet of paper on other side 20*b*) and so in a simple operation easy to paste. There is no likelihood that off the split double sheets 60 or the sheet of paper on other side 20*b* transported will come the integrating paste 42*a* pasted thereon.

A said booklet-like product 70 is transported by the belt conveyer 82 (92) and the booklet transport unit 10 into the trimming unit 11.

In the trimming unit 11, three sides of the booklet-like product 70 as shown in FIG. 10 are cut to form a booklet 80.

In cutting of the booklet-like product 70, it is cut along the one dot chain line a as indicated in FIG. 9 to cut off a widthwise one side edge area. As a result, of the second and fourth split double sheets 62 and 64, portions bonded with the throwaway paste 41*a* are cut off, separating the 1st page of the booklet C and the 4th page of the booklet B of the second split double sheet 62 from each other and separating the 1st page of the booklet B and the 3rd page of the booklet A of the fourth split double sheet 64 from each other.

Figure 11A:
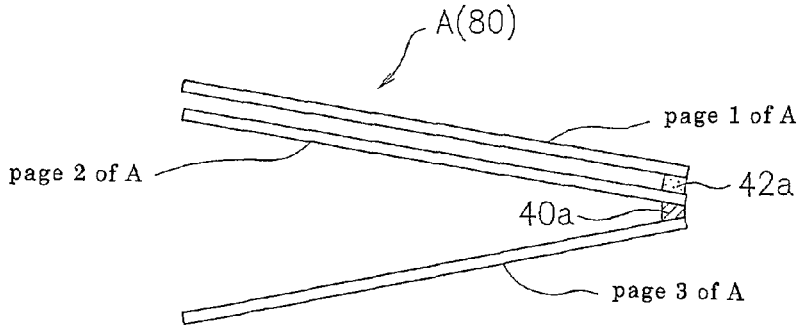
FIGS. 11A, 11B and 11C are explanatory views illustrating three booklets in which sheets of split double sheets constituting their leaves (pages) are pasted.
Figure 11B:
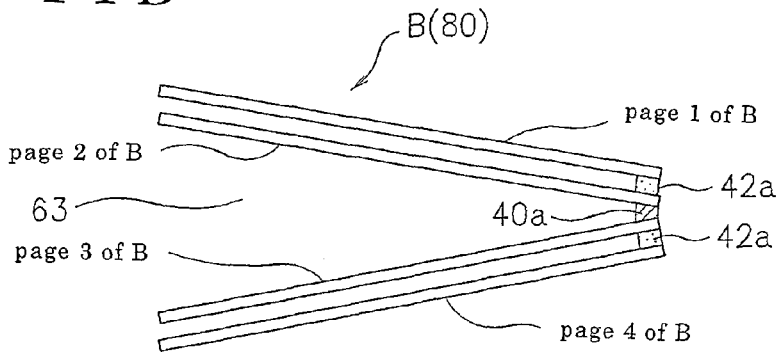
Figure 11C:
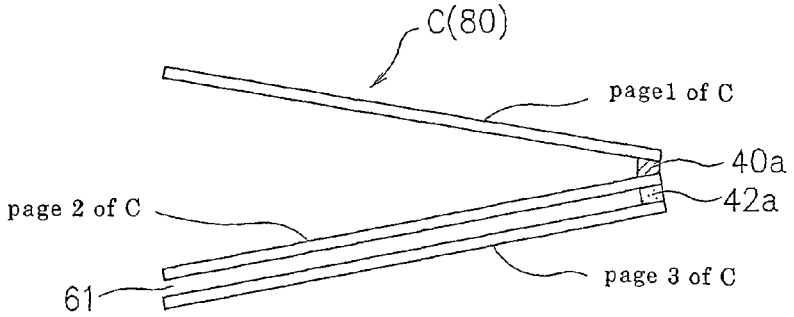

As a booklet 80, there are consequently fabricated a booklet A having three sheets bound together as shown in FIG. 11A, a booklet B having four sheets bound together as shown in FIG. 11B and a booklet C having three sheets bound together as shown in FIG. 11C.

It is thus possible to fabricate booklets comprising those of an even number or numbers and an odd number or numbers of leaves which are mixed randomly or as desired, without causing waste of paper.

Figure 12:
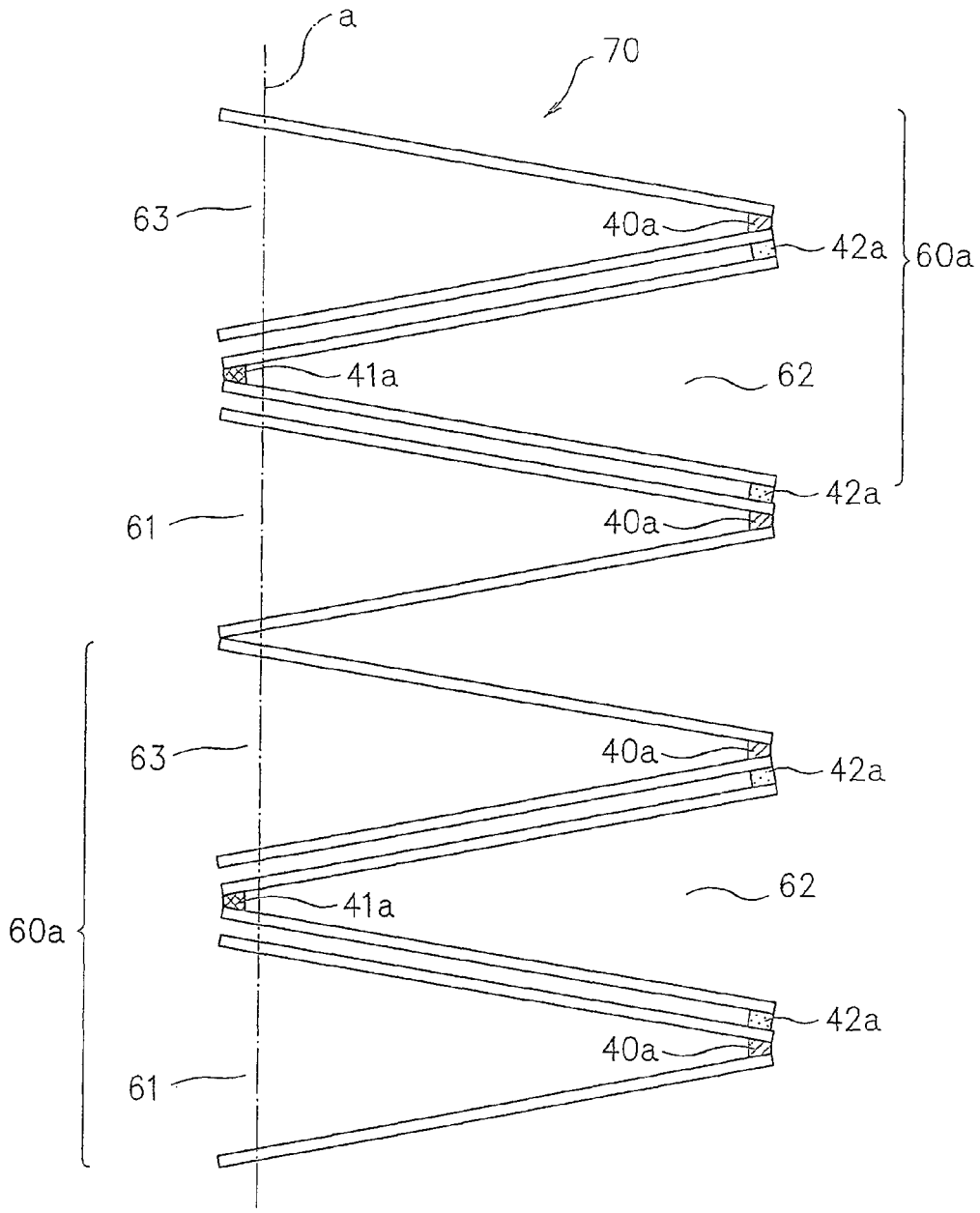
FIG. 12 is an explanatory view illustrating a method of forming booklets each having an odd number of leaves from a booklet-like product having split double sheets connected together by pastes.

As a booklet to be fabricated only of an odd number of leaves, three split double sheets 60*a* as a group as shown in FIG. 12 may be taken constituted by a first split double sheet 61, a second split double sheet 62 and a third split double sheet 63 which are bonded together as mentioned above, such groups being successively piled to form a booklet-like product 70 which is then cut along the line of cut to cut off the widthwise one side edge portion.

When a booklet is to be fabricated only of an even number of leaves, a double set continuous sheet of paper having a first continuous sheet of paper on one side and a second continuous sheet of paper on the other side bonded together with a setting paste at widthwise other side edge portions is cut to form a plurality of split double sheets of a longitudinal length which may be laid one on another and then bonded at widthwise other side edge portions with an integrating paste.

While an odd number and even number of leaves of a booklet have been described to be 3 and 4, these are not to be taken as a limitation but may be substituted with any odd and any even number.

Also, while a booklet-like product 70 has been described as being cut off at its three sides, only the portions bonded with a throwaway paste 41*a* may be cut off for separation.

What is claimed is:

1. A booklet making method comprising:

cutting a web of paper having a plurality of booklet page sections on each of widthwise one and other sides of the web of paper, into a first and a second continuous sheet of paper on said widthwise one and other sides, wherein each of the plurality of booklet page sections are spaced apart from one another in a transport direction of the web of paper;

laying the first and second continuous sheets of paper one on the other, and forming a double set continuous sheet of paper by bonding widthwise one side edges of a pair of overlapping such booklet page sections together with a throwaway paste only on said one side edges of said pair of overlapping such booklet page sections and bonding widthwise other side edges of a next adjacent pair of such overlapping booklet page sections together with a setting paste only on said other side edges of said next adjacent pair of such overlapping booklet page sections;

cutting said double set continuous sheet of paper into split double sheets comprising pairs of sheets having such pairs of overlapping booklet page sections;

laying said split double sheets one on another and bonding widthwise other side edges of adjacent sheets of adjacent two of said split double sheets together with an integrating paste, thereby forming a booklet-like product comprising an odd number of sheets and an even number of sheets both of which are individually bound at said widthwise other side edges; and cutting off those edge portions of said split double sheets which are bonded with the throwaway paste, thereby forming a plurality of booklets which comprise the sheets of said page sections.

2. A booklet making method comprising:

cutting a web of paper having a plurality of booklet page sections on each of widthwise one and other sides of the web of paper, into a first and a second continuous sheet of paper on said widthwise one and other sides, wherein each of the plurality of booklet page sections are spaced apart from one another in a transport direction of the web of paper;

laying the first and second continuous sheets of paper one on the other, and forming a double set continuous sheet of paper by bonding widthwise one side edges of a pair of overlapping such booklet page sections together with a throwaway paste only on said one side edges of said pair of overlapping such booklet page sections and bonding widthwise other side edges of a next adjacent pair of such overlapping booklet page sections together with a setting paste only on said other side edges of said next adjacent pair of such overlapping booklet page sections;

cutting said double set continuous sheet of paper into split double sheets comprising pairs of sheets having such pairs of overlapping booklet page sections;

laying said split double sheets one on another and binding adjacent sheets thereof together for an odd number of such sheets at said widthwise other side edge with an integrating paste, to form a group of such odd numbers of sheets so bound together, thereby forming a booklet-like product comprising such groups piled one on another; and cutting off a widthwise one side edge of said booklet-like product, thereby separating portions of said split double sheets which are bonded with said throwaway paste to form a plurality of booklets which comprise sheets of said page sections.

3. A booklet making apparatus which comprises:

first cutting means for cutting a web of paper, which has a plurality of booklet page sections on each of widthwise one and other sides of the web of paper, into a first and a second continuous sheet of paper on said widthwise one and other sides, wherein each of the plurality of booklet page sections are spaced apart from one another in a transport direction of the web of paper, side edge truing-up means for truing up the first and second continuous sheets of paper to bring them into coincidence with each other in side edge, pasting means for pasting, superposing means for laying the first and second continuous sheets of paper one on top of another to form a double set continuous sheet of paper, second cutting means for cutting the double set continuous sheet of paper into a plurality of split double sheets, piling means for laying the split double sheets one on top of another and causing them to be bonded together to form a booklet-like product, and trimming means for cutting off unnecessary portions of the booklet-like product to form a plurality of booklets therefrom, wherein said pasting means comprises:

a double sheet setting pasting means for pasting a first plurality of booklet page sections from among the plurality of booklet page sections of the first continuous sheet of paper with a setting paste only on widthwise other side edge portions of the first plurality of booklet page sections of the first continuous sheet of paper, a throwaway pasting means for pasting a second plurality of booklet page sections, which are other than the first plurality of booklet page sections, which are from among the plurality of booklet page sections of the first continuous sheet of paper and which are arranged alternately with the first plurality of booklet page sections in the transport direction of the web of paper, with a throwaway paste only on widthwise one side edges of the second plurality of booklet page sections of the first continuous sheet of paper, and an integrating pasting means for pasting widthwise other side edge portions of the second continuous sheet of paper with an integrating paste, and wherein said trimming means is adapted to cut off portions of the booklet-like product which are pasted and bonded with the throwaway paste.

* * * * *